US011014716B2

(12) United States Patent
Tyler et al.

(10) Patent No.: US 11,014,716 B2
(45) Date of Patent: May 25, 2021

(54) PLASTIC CONTAINER BODY AND CONTAINER CLOSURE AND CARRY HANDLE GRIP / CONTAINER LEVERAGE OPENING TOOL ASSEMBLY

(71) Applicants: Glenn Norman Tyler, Chonburi (TH); Kem Weichoreak Kang, Bangkok (TH)

(72) Inventors: Glenn Norman Tyler, Chonburi (TH); Kem Weichoreak Kang, Bangkok (TH)

(73) Assignees: Glenn Norman Tyler, Chonburi (TH); Kern Weichoreak Kang, Bangkok (TH)

( * ) Notice: Subject to any disclaimer, the term of this patent is extended or adjusted under 35 U.S.C. 154(b) by 76 days.

(21) Appl. No.: 16/324,560

(22) PCT Filed: Aug. 11, 2016

(86) PCT No.: PCT/TH2016/000069
§ 371 (c)(1),
(2) Date: Feb. 10, 2019

(87) PCT Pub. No.: WO2018/030963
PCT Pub. Date: Feb. 15, 2018

(65) Prior Publication Data

US 2019/0168927 A1 Jun. 6, 2019

(51) Int. Cl.
*B65D 43/06* (2006.01)
*B65D 43/02* (2006.01)
(Continued)

(52) U.S. Cl.
CPC ..... *B65D 43/0245* (2013.01); *B44D 3/127* (2013.01); *B65D 25/00* (2013.01);
(Continued)

(58) Field of Classification Search
CPC ..... B65D 25/2852; B65D 43/0245; B65D 43/06; B65D 43/0256; B65D 51/1688; B65D 51/16; B65D 25/00; B44D 3/127
(Continued)

(56) References Cited

U.S. PATENT DOCUMENTS 3,809,280 A * 5/1974 Park ..... B65D 51/1688 220/785
2002/0175173 A1* 11/2002 Diesterbeck ..... B65D 43/0212 220/782

(Continued)

*Primary Examiner* — King M Chu
(74) *Attorney, Agent, or Firm* — Soroker Agmon Nordman

(57) ABSTRACT

A plastic injection moulded wide mouth container body and container cover locking and sealing mechanism which includes an annular flange and an annular angular notch groove respectively in a pre-determined configuration so as to provide a tight leak-proof seal when the container lid is fitted over, around and within the container body hoop annular fin and upon locking engagement. The present invention incorporates a multi-use plastic handle grip which may also be used as a closure opening levering tool to disengage the container lid from the container body in a safe and ergonomic manner. More significantly the invention, and when in use and upon first usage opening, does not require the removal of any portion of the container lid to comply with tamper evident requirements, nor needs other tools such as knives and metal levers to completely remove the container closure from the container body. Still furthermore the invention includes a plurality of venting channels and adjacent ports which allows the evacuation of increased internal air pressure within the closed container head space with no leakage of the packaged fluid product. The invention may be adapted to plastic containers of any size and shape being round, oval, square or rectangular tapered or straight wall containers.

16 Claims, 17 Drawing Sheets

(51) Int. Cl.

| | |
|---|---|
| ***B65D 51/16*** | (2006.01) |
| ***B44D 3/12*** | (2006.01) |
| ***B65D 25/00*** | (2006.01) |
| ***B65D 25/28*** | (2006.01) |

(52) U.S. Cl.
CPC ..... *B65D 25/2852* (2013.01); *B65D 43/06* (2013.01); *B65D 51/16* (2013.01); *B65D 51/1688* (2013.01); *B65D 2543/005* (2013.01); *B65D 2543/00092* (2013.01); *B65D 2543/00194* (2013.01); *B65D 2543/00296* (2013.01); *B65D 2543/00453* (2013.01); *B65D 2543/00657* (2013.01)

(58) Field of Classification Search
USPC ..... 220/214
See application file for complete search history.

(56) References Cited

U.S. PATENT DOCUMENTS

| | | | | |
|---|---|---|---|---|
| 2005/0184070 | A1* | 8/2005 | Boback ..... | B65D 43/021 220/266 |
| 2012/0305560 | A1* | 12/2012 | Minnette ..... | B44D 3/128 220/260 |
| 2013/0181001 | A1* | 7/2013 | Kloss ..... | B65D 43/02 220/796 |

* cited by examiner 14 a 14 b 14 c 14 d

PLASTIC CONTAINER BODY AND CONTAINER CLOSURE AND CARRY HANDLE GRIP / CONTAINER LEVERAGE OPENING TOOL ASSEMBLY

TECHNICAL FIELD

The present invention relates to a container and in particular to An improved container cover and container body locking mechanism which will prevent contents from the assembled container from flowing out when the container is displaced from its vertical axis.

The invention further relates to a container cover and container body locking sealing-mechanism which does not separate or leak when the container is subjected to a free fall around its axis from a height of about 1.0 meter.

Furthermore the invention relates to a container cover which may be easily, safely and ergonomically detached from the container pail by using another embodiment of the invention being the detachable plastic handle grip. When the plastic handle grip is removed from the fitted wire handle it may be used as a lever to firstly pivotally and partially separate and or shear the integral lever panel of the container pail hoop which when in motion turns the container cover outer annular, angular and elastic shirt locking profiles upwards and outwards towards a ninety degree perpendicular position from its closed position. This dynamic action and movement effectively disengages the containers corresponding container cover annular flange away from the container body notch groove profile which allows easy and ergonomic opening of the container. This manipulation is provided normally by the container end user being of average adult human strength and to gain access to the packaged product.

Upon refitting of the container closure firstly onto and within the container body the container closure inverted elastic locking skirt may be pushed in a downwards motion reengaging the corresponding container body and container closure corresponding annular flange and annular groove in a helical motion.

Furthermore no member part of the whole container needs to be removed and no compromising of the locking mechanism physical strength occurs when opening the container. Upon first removal of the container closure from the container body tamper evidence is clearly and visually evident due to the partial separation of the levered container body integral hinged level panel from the container body outer annular skirt.

Even furthermore the invention incorporates a unique internal air pressure bleeding profile which allows higher than normal air pressure within the closed and sealed container to escape through venting grooves and ports without leakage of the packaged fluid product. Those familiar in the art of wide mouth packaging design and usage will understand the need for such a venting system which firstly allows a faster container closure fitment onto the container body particularly when the container body member parts is closed on a high speed product capping machine. Displacement of trapped air is a major problem and bulging of the container closure top centre panel is the adverse result. Furthermore those familiar with the fitting of such wide mouth closures understand the existing problems and refer to such removal of built up internal pressure as burbing the container. The invention, as such, does not require burping to relieve the internal air pressure as any buildup of internal pressure, and for whatever reason, is gradually and effectively evacuated from the container head space chamber commonly known as the container ullage space.

Still furthermore, and due to the improved advancements and developments in the rheology of plastic polymers and injection moulding processes, it is now possible to produce thinner and more malleable elastic part profiles particularly in the regions were sealing and locking is critical. The invention profiles are designed and fashioned accordingly to achieve vastly improved performance when compared to existing prior art designs and similar wide mouth packaging locking and sealing integral mechanisms.

BACKGROUND ART

Ordinary prior art wide-mouthed plastic pail and closure containers suffer distinct disadvantages with regard to meeting various known and consumer requested performance and handling market expectations. Typical containers that are in popular use for the packaging of a wide variety of products such as emulsion based paints, lubricants, greases and food products normally cannot effectively be resealed after the closure has been opened once. Prior art containers which have effective sealing devices are usually elaborately designed and are relatively expensive to manufacture due to the need to have vulcanized rubber O-ring seals to achieve effective and reliable seal-ability.

Furthermore conventional plastic container locking mechanisms cannot withstand force exerted externally during normal use. Conventional plastic containers also are not capable of being stacked one on top of another in a warehouse, as the lower units become distorted due to the increased top load weight mainly due to lid deformation.

Still furthermore ordinary plastic containers, particularly used to package industrial products such as paints, may be opened quite easily without any visual sign of tamper evidence in spite of the fact that tamper evident removable tear strips and tabs are in place.

Even furthermore conventional prior art container designs that comply with market tamper evidence requirements are often extraordinarily difficult to open with the need to use tools such as knives, cutters and levers which may cause serious injury.

Still furthermore, and due to the removal of such prior art tamper evidence strips and tabs, responsibility must be taken by the manufacturing supplier to ensure that these parts are recovered and sent for recycling and according to ISO 14,000 and Cradle to Grave laws.

Another most serious negative disadvantage of ordinary prior art containers, and those that achieve absolute internal leak proof and air tight seal ability, is the negative affect when the air space above the packaged liquid and the underside of the container lid, commonly known as the container ullage, is exposed and or subjected to increased external heat and or when there is a change in the outer atmospheric pressure. Container cover bulging and distortion including the ultimate leakage of the packaged fluid will occur when the filled containers are transported, for instance sake, from sea level to higher altitudes and over rough terrain.

Furthermore, and when these containers are exposed to an increase in external ambient heat the container cover centre recessed panel bulges outwards making stacking of multiple containers (4-5 high) in a single unsupported column impossible.

The present invention provides solutions to all the above mentioned negative aspects of existing prior art wide mouth plastic container body and container cover assemblies.

SUMMARY OF INVENTION

It is a principal object of the present invention to provide a container cover and container body locking mechanism whereby a tight and leak proof seal is created.

It is another object of the present invention to provide a container cover and container body locking mechanism which can withstand a strong force when applied across and along the vertical and/or radial axis of the corresponding container body and closure locking mechanisms.

Other objects of the present invention are to provide a seal-able container to hold flow-able substances, which is inexpensive to manufacture, is reusable, provide a reliable airtight and liquid tight locking and sealing mechanism and continue to do so when opened and closed a great number of times and when in use.

Still furthermore, another object of the invention is to achieve visible tamper proof evidence of first opening without the need to remove any part of the lid or pail outer skirt which is common practice with most other prior art container designs. New cradle to grave international recycling laws now are enforcing that any container detachable member part is the responsibility of the packaging manufacturer with taxes applicable for the recovery of the detached packaging part.

Another preferred embodiment of the invention has a sealable container comprising a container body and a seal-able container lid which is completely fit-able thereto. The container body has an open top with a rim there around, an annular flange spaced apart in a selected spatial relationship and extending radially outwards from the external wall of container body. The annular flange is integrally formed with the container body. The annular flange which is integrally connected to the container body rim includes an annular skirt extending radially outwards from an underneath part of the annular flange. The cover lid has an annular skirt which includes annular angled ring band formed thereon in the same spatial relationship as that of the annular flange notch groove of the container body, whereby the annular angled ring band is snap fasten-able over and within the corresponding container body annular flange notch groove. The cover lid further includes annular curtains disposed from the undersurface of the lid and configured to fit in a close size for size contact with the inner and outer wall of the container body upper ring annular curtain.

In another aspect of the invention a plurality of strengthening fins are disposed between the annular skirt of the container body and the external wall of the container body, the fins being integrally formed with the annular skirt and the container body.

A plurality of strengthening fins are disposed between the first annular curtain of the container closure and the underneath portion of the lid cover, and a plurality of second fins being integrally formed with the lid outer skirt and the second annular curtain respectively.

The annular skirt of the container lid includes an annular, angular and elastic ring band which after engagement onto the container body in its locked and scaled condition may be physically inverted and folded upwards and away from the corresponding container body outer skirt annular notch groove enabling container opening in a safe, easy and ergonomic manner.

Still furthermore the container may be opened using the provided snap fasten able multipurpose plastic moulded carry handle grip/container opening tool. This leverage tool, and after complete removal of the closure, may be reattached to the mating container body steel rod handle assembly in readiness for its container carrying application.

Even furthermore the present invention includes a plurality of air pressure evacuation vent channels and ports to aid in the normalization of the internal pressure of the container and when subjected to various atmospheric and ambient temperature conditions particularly when being transported on an open back lorry or stored in direct sunlight.

Other applications of the present invention will become apparent to those skilled in the art when the following description of the best mode contemplated for practicing the invention is read in conjunction with the accompanying drawings.

BRIEF DESCRIPTION OF DRAWINGS

In order that the invention may be easily understood and carried into effect, it will now be described with reference to the accompanying drawings as an example of an embodiment of the invention, wherein.

DESCRIPTION OF EMBODIMENTS

The container body [10] has an open top [12] with a rim [14] there around. An annular skirt [24] extends radially outwards adjacent to the base of the rim wall [14] which includes a radially upward and outward annular flange [16] with an inner annular flange [18] and an outward annular flange [20] in a concentric spaced apart relation to the inner annular flange. Preferably the outer annular flange [20] is angled at the top outer corner so as to allow for engagement with the container closure [30] mating profile [45].

Figure 7:
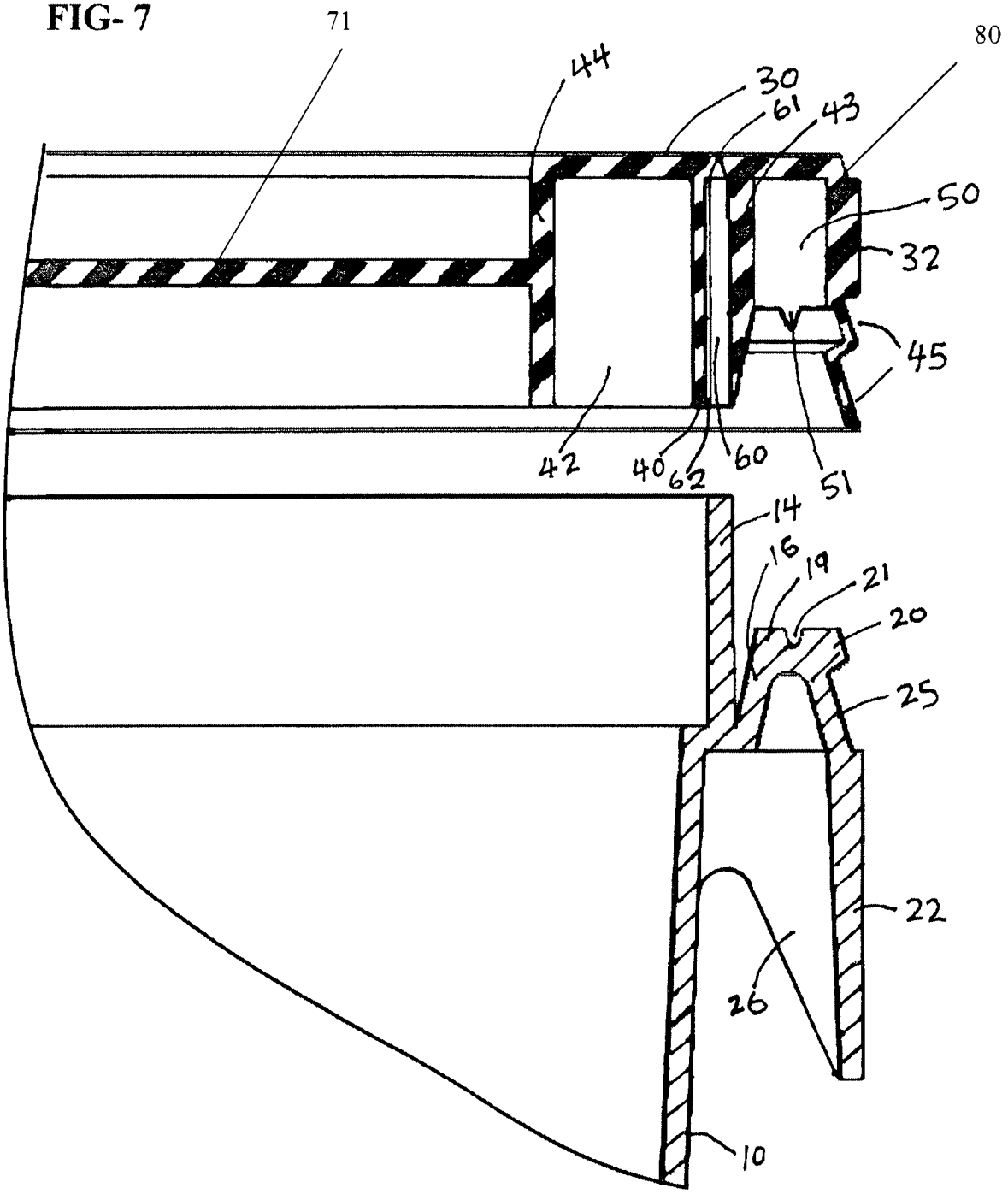
FIG. 7 is a detailed enlarged cross sectional elevation view of the container and cover before engagement and as shown in FIG. 5
Figure 8:
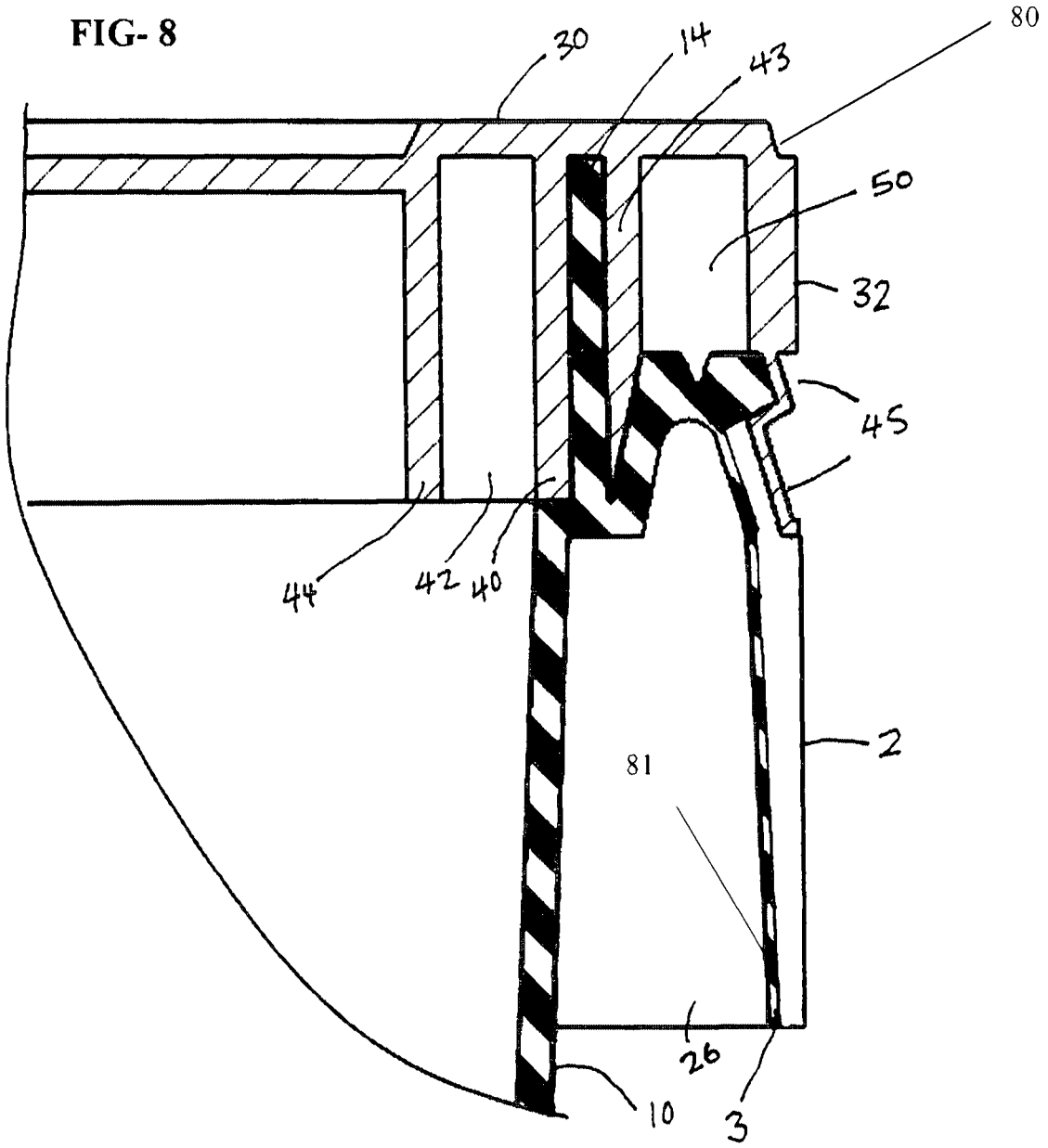
FIG. 8 is a detailed enlarged cross sectional elevation view of the container and cover after engagement in its final working position.

The container body [10] annular flange [22] includes an annular notch [25] which creates an engagement recess slot for the container closure [30] corresponding annular and angled elastic flange [45] which creates the effective locking and sealing condition and upon container member part engagement. FIG. 7 and FIG. 8 clearly illustrates such accurate and positive engagement.

To provide rigidity and to provide a means to absorb lateral impact force applied to the skirt [22] a plurality of strengthening ribs [26] is provided to connect the underside of the shirt [22] and the container body [10]. The fins [26] comprise a plurality of substantially vertical fins extending from the extreme lower inner edge of the skirt [22] connecting with annular flange [16] and annular flange [25]. From a side elevation view the fins are clearly observable in FIG. 7 and FIG. 8.

The container cover [30] best observed in axial cross sectional view in FIG. 7 and FIG. 8 includes an outer annular skirt member [32] which is integrally connected to the extending downwards annular and angular elastic locking flange [45] and in a spatial geometric relationship corresponding to that of the container body [10] annular skirt notch [25]. The container cover [30] further includes annular curtains [43], [40] and [44] which is disposed beneath the container cover [30] and is disposed to fit into the container body [10] mating recesses and rim. The central annular panel [71] of the container cover [30] is recessed and sized geometrically so as to receive the base chime [70] of the container body [10] when the assembled and filled containers are stacked in a single column usually 4 to 6 containers high. The container cover [30] includes a plurality of inner strengthening fins [42] on the underside of the cover [30] connecting the annular curtains [40] and [44] portions of the cover to strengthen the distal end region of the cover and mainly to improve top load strength when the filled containers are stacked in a single column. See FIG. 8. The container cover [30] also includes a plurality of strengthening fins [50] on the underside of the container cover [30] connecting the annular curtain [43] and the outer annular skirt member [32]. Once again the addition of such ribs improves the lateral and top load performance of the cover. See FIG. 8.

It will be observed that the container cover [30] annular flanges and curtains are designed and dimensionally configured to provide a tight fitting, leak proof and air tight condition when fitted over and within the container body [10] inner and outer top hoop profiles and outer flange recess. In another aspect of the invention, a portion of the container body [10] annular skirt member [22] has a semi detachable lever panel [2] provided which is integrally hinged [4] with two adjacent "V" shaped grooves [3] which when manually levered upwards and outwards in an arc motion will partially separate from the container body annular skirt [22] along the length of the two grooves [3]. These weakened sectional "V" shaped grooves [3] are substantially perpendicular to the integral hinge [4].

Yet another aspect of the invention is the use of the container plastic hand grip [37] which is manually detachable from the provided metal road handle/grip assembly [38].

Figure 15:
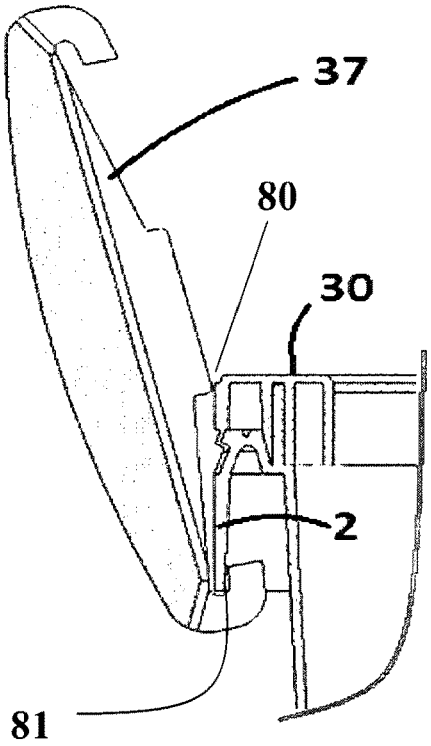
FIG. 15 is a cross sectional elevation view of another embodiment of the invention showing the removable plastic handle grip into its predetermined first position and to commence the process of removal of the cover from the container.
Figure 16:
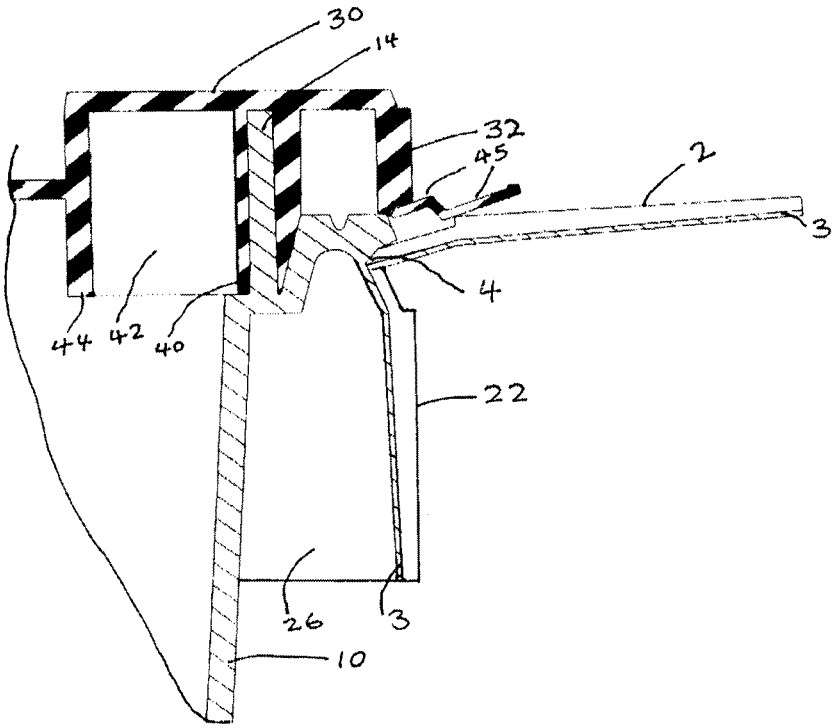
FIG. 16 is another detailed enlarged sectional elevation view of the disengagement of the container body and container closure locking mechanism.

Once removed the plastic handled grip may be inverted with one section positioned over and on top of the container closure [30] uppermost top panel perimeter profile [80] and hooked on the inner side of the container body lever panel [2] and for the purpose of levering the container body [10] lever panel [2] upwards in an arc motion partially separating the lever panel [2] from the main container body [10] annular notch groove [25] and annular outer skirt [22] and as illustrated in FIG. 15.

This action transmits motion and may be used to safely and ergonomically remove the container cover [30] from the container body [10]. As shown in FIGS. 14*a*, 14*b*, 14*c*, 14*d* and FIG. 15 such manually applied leverage motion will fold the container cover [30] annular and outer angled elastic bands [45] outwards and upwards effectively folding and inverting the profile away from the container body [10] annular and outer annular notch groove [25].

Yet another preferred embodiment of the invention is the ease at which the container cover [30] can be reapplied to the container body [10] in a leak proof, air tight condition. When the container has been opened the container cover [30] annular and outer annular, angled elastic ring band [45] is in an inverted position when compared to its closed position and when engaged with the corresponding container body annular groove [25]. To reclose the container the closure [30] is placed over the container body [10] and when downward pressure is applied over and around the annular, angled and elastic rings bands [45] the annular rings bands will flip back into position in a helical motion engaging with the container body [10] annular notch groove [25]. This practice may be repeated numerous times without compromising the integrity of the fit between the two mating container member profiles.

It will be appreciated that the container cover locates easily over the container body. When pressure is applied downwards from the top of closure towards the container, the plurality of annular curtains [44, 40 and 43] slide snugly within the container body [10] corresponding annular groove [60] and the container closure [30] annular and outer angled flange [45] engages into its lockable and leak proof orientation with the container body [10] annular notch flange [25].

Once in a closed position, the container closure [30] cannot be removed from the container body [10] unless the lever panel [2] has been partially disengaged from the container body annular skirt member [22] and as described. Once this partial disengagement has occurred the lever panel [4] cannot be completely re-attached in its first manufactured position to the container body [10] annular skirt [22] therefore showing evidence of tampering or most importantly pre-sale opening. What is particularly visually obvious is the two adjacent weakened thinner grooves [3] have been sheared away causing separation from the container body [10] annular skirt member [22] therefore proof of container opening is clear and to the naked eye tamper evident.

Figure 1:
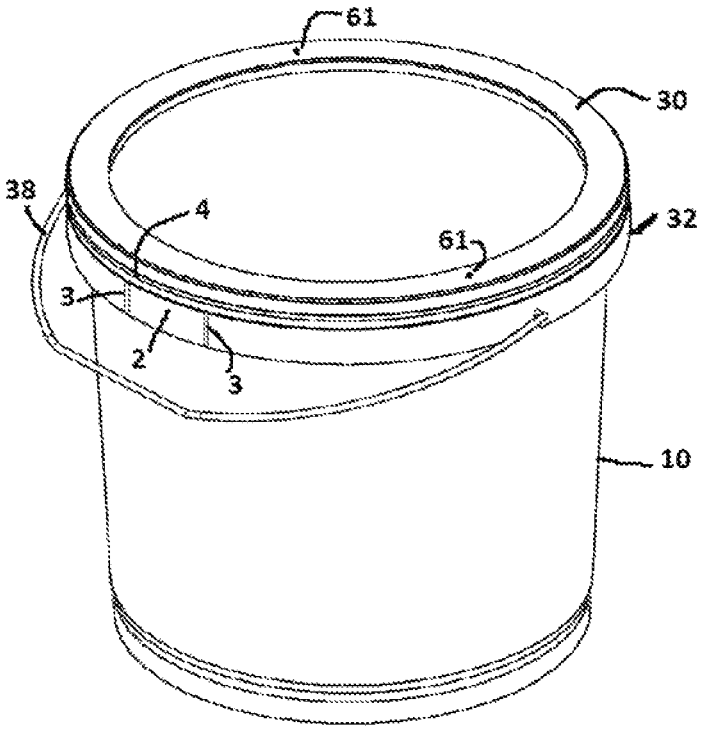
FIG. 1 is a perspective view of an embodiment of the round cylindrical and tapered container and cover closed in its final engaged position and when in use.
Figure 2:
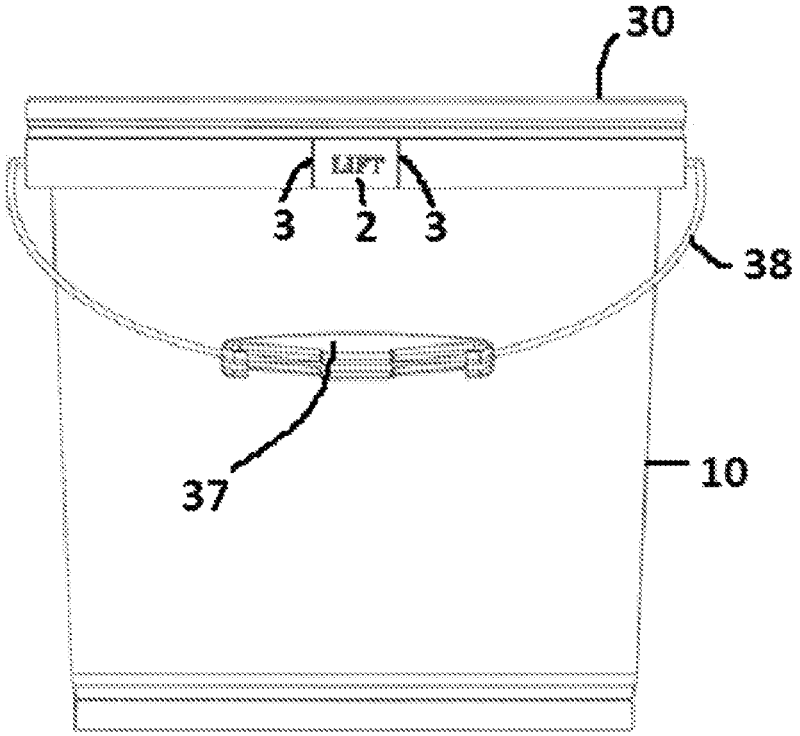
FIG. 2 is a side elevation view of the embodiment shown in FIG. 1 with the multi-use handle grip/leverage tool in place.
Figure 3:
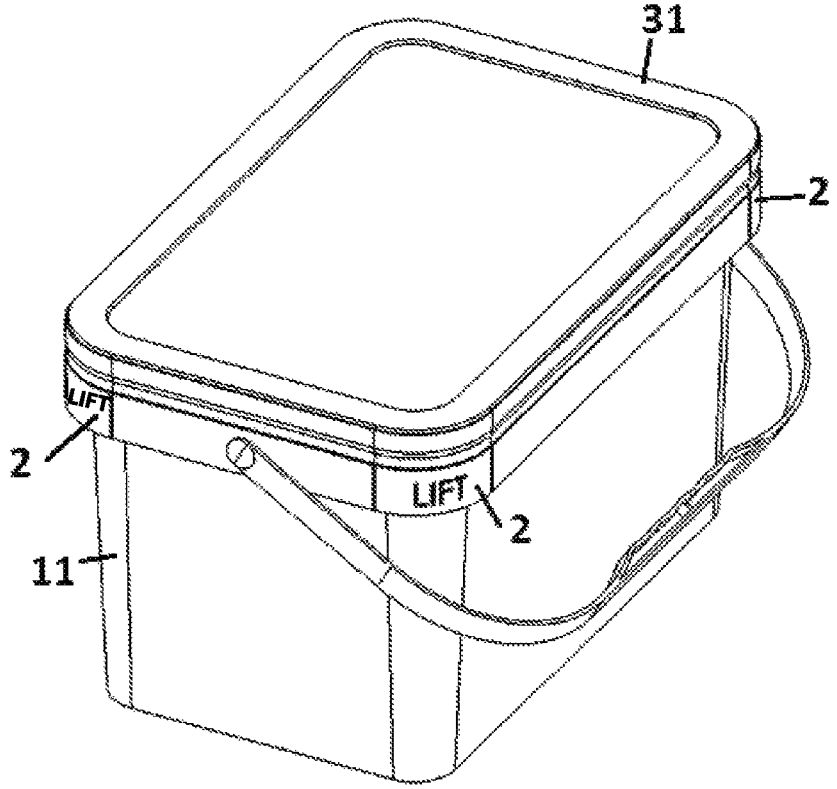
FIG. 3 is a perspective view of an embodiment of the rectangular tapered container and cover closed in its final engaged position and when in use.
Figure 4:
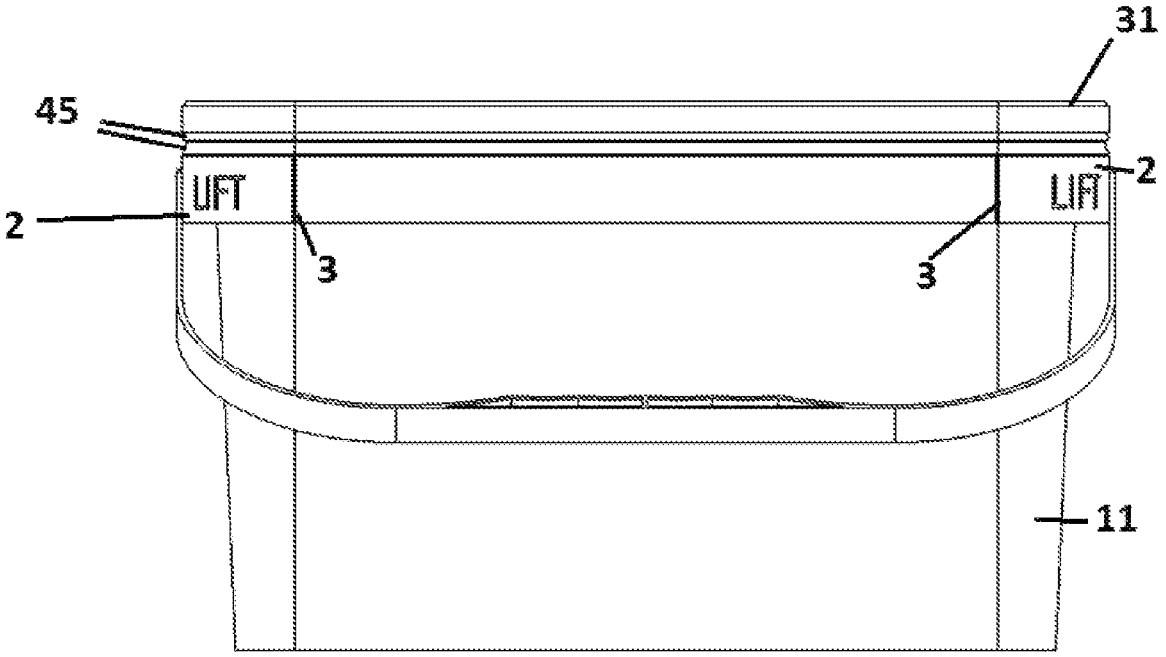
FIG. 4 is a side elevation view of the embodiment shown in FIG. 3.
Figure 5:
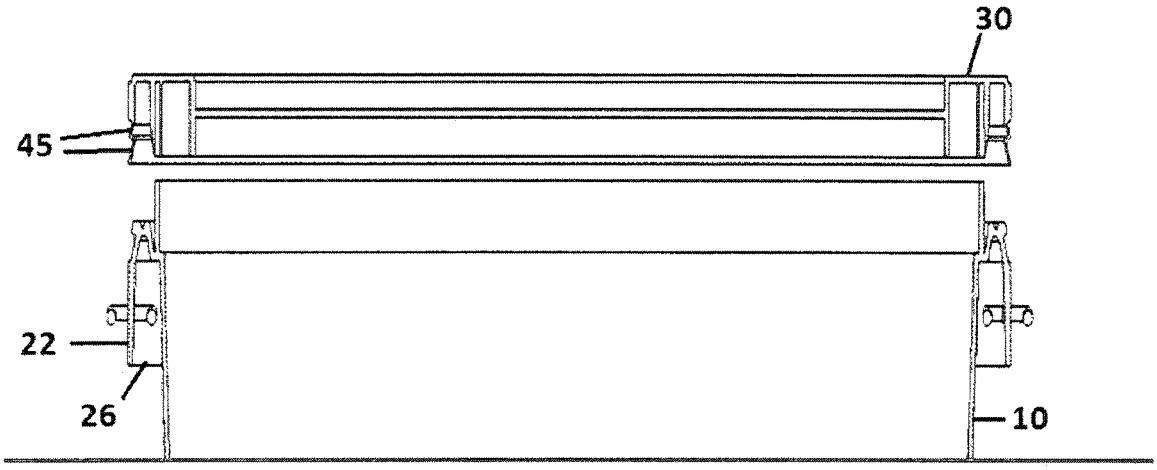
FIG. 5 is a detailed cross sectional elevation view of the container body and container cover before engagement.
Figure 6:
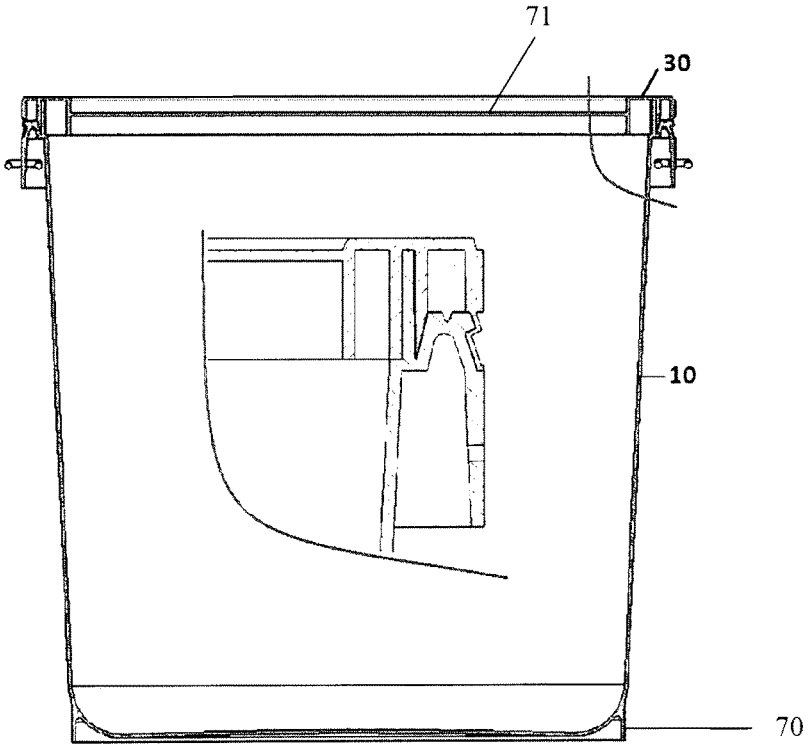
FIG. 6 is a cross sectional view of the container and cover assembly where the lid contains fin blades on the underside of the lid and a magnified view of the container and closure cross section upon engagement.

Still further more the invention member profiles may be adapted to any shape wide mouth container body and container closure and more specifically to any size ranging from 1 litre capacity to 30 litre capacity. As shown in FIG. 1 illustrating the container body [10] and the container closure [30] and FIG. 3 illustrating the rectangular container body [11] and the rectangular container closure [31] the present invention embodiments may be included as an integral part of both cylindrical and rectangular containers but also other non-round container shapes such as square and oval containers without compromising the leak proof, air tight, impact resistance, top load and tamper evidence performance compliance of the containers.

Figure 9:
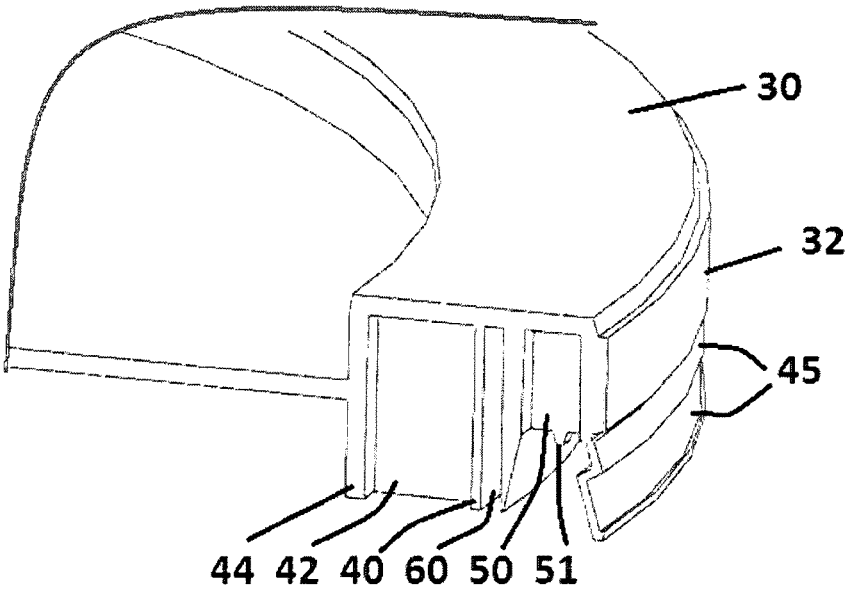
FIG. 9 is a scrap sectional perspective view of the closure.
Figure 10:
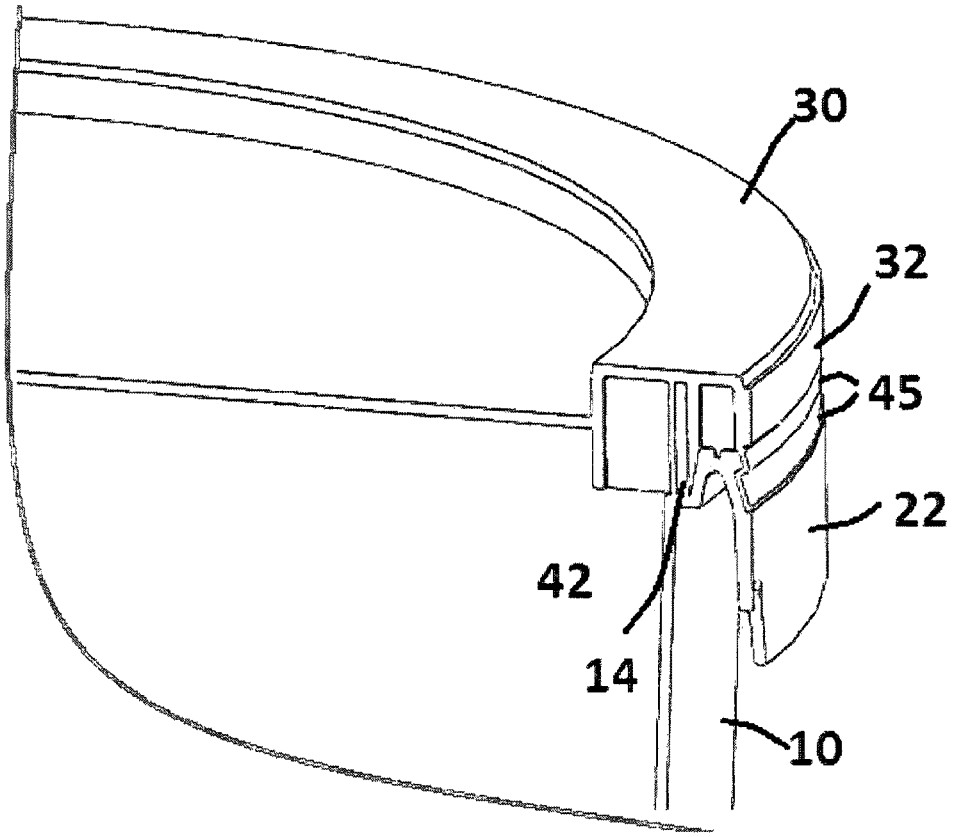
FIG. 10 is a cross sectional perspective view of the closure and container after engagement and in its final working position.
Figure 11:
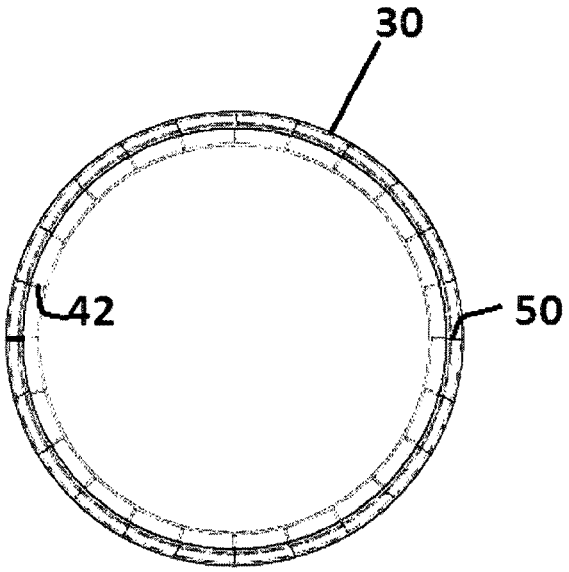
FIG. 11 is a plan view of the lid, looking into the underside of the round closure from its open end.
Figure 12:
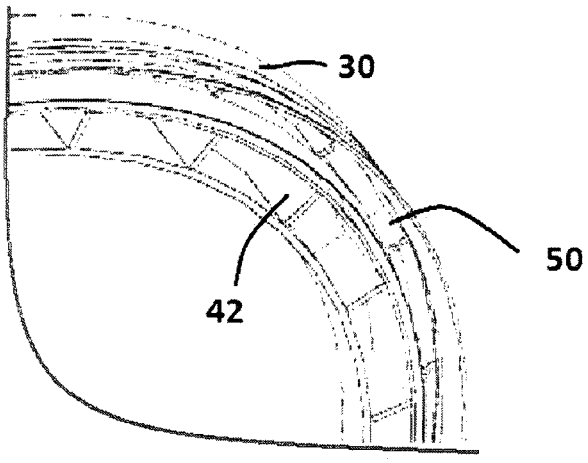
FIG. 12 is a cross sectional perspective view of the closure.
Figure 13:
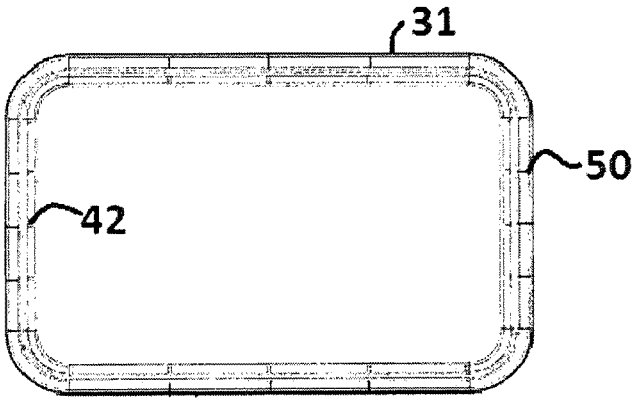
FIG. 13 is a plan view of the lid, looking into the underside of the rectangular closure from its open end.
Figure 14:
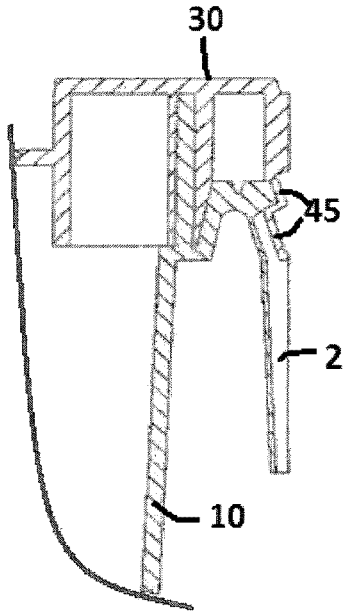
FIGS. 14A, 14B, 14C and 14D shows a cross sectional view of the container and cover and during the dynamic process being the gradual leverage disengagement of the two mating locking parts of the container body and container closure to its opened and tamper evident position.
Figure 14:
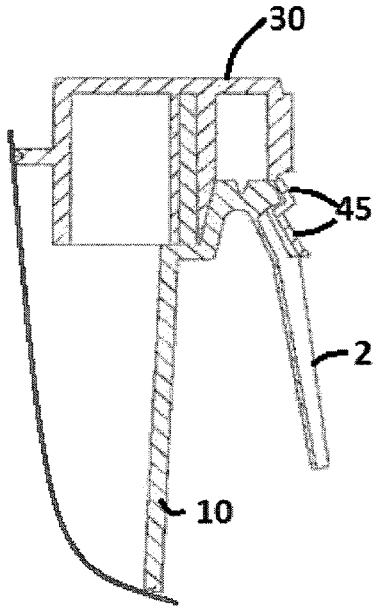
Figure 14:
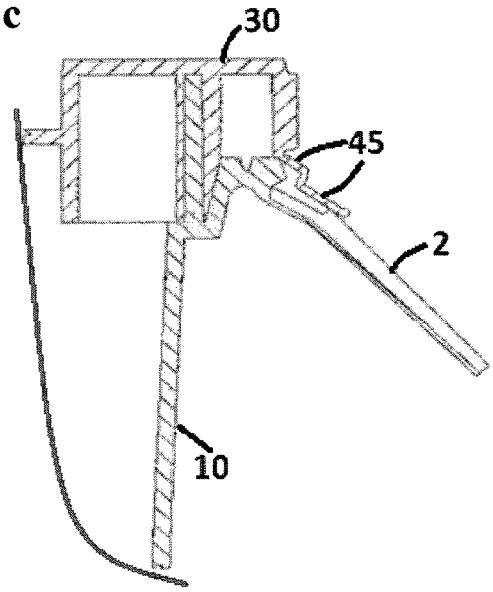
Figure 14:
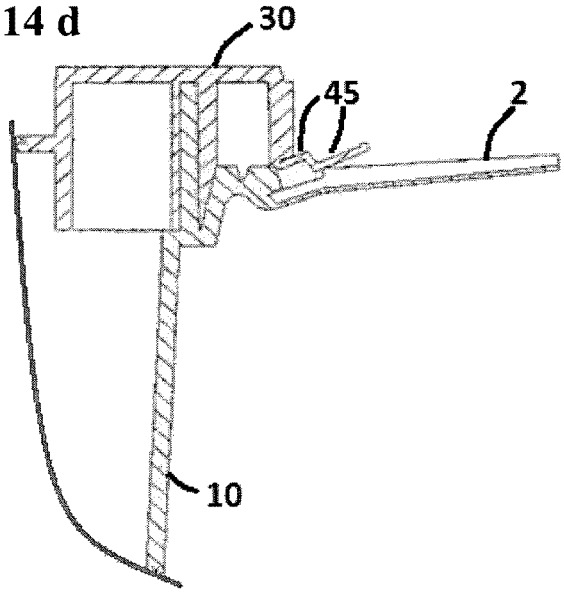

Even further more, and when market performance requirements do not include increased side wall and lateral impact and top load performance, the strengthening fins and as shown in the FIG. 9 and FIG. 10 being the invention member part [42], may be removed or not added as an integral part of the container cover [30].

Figure 20:
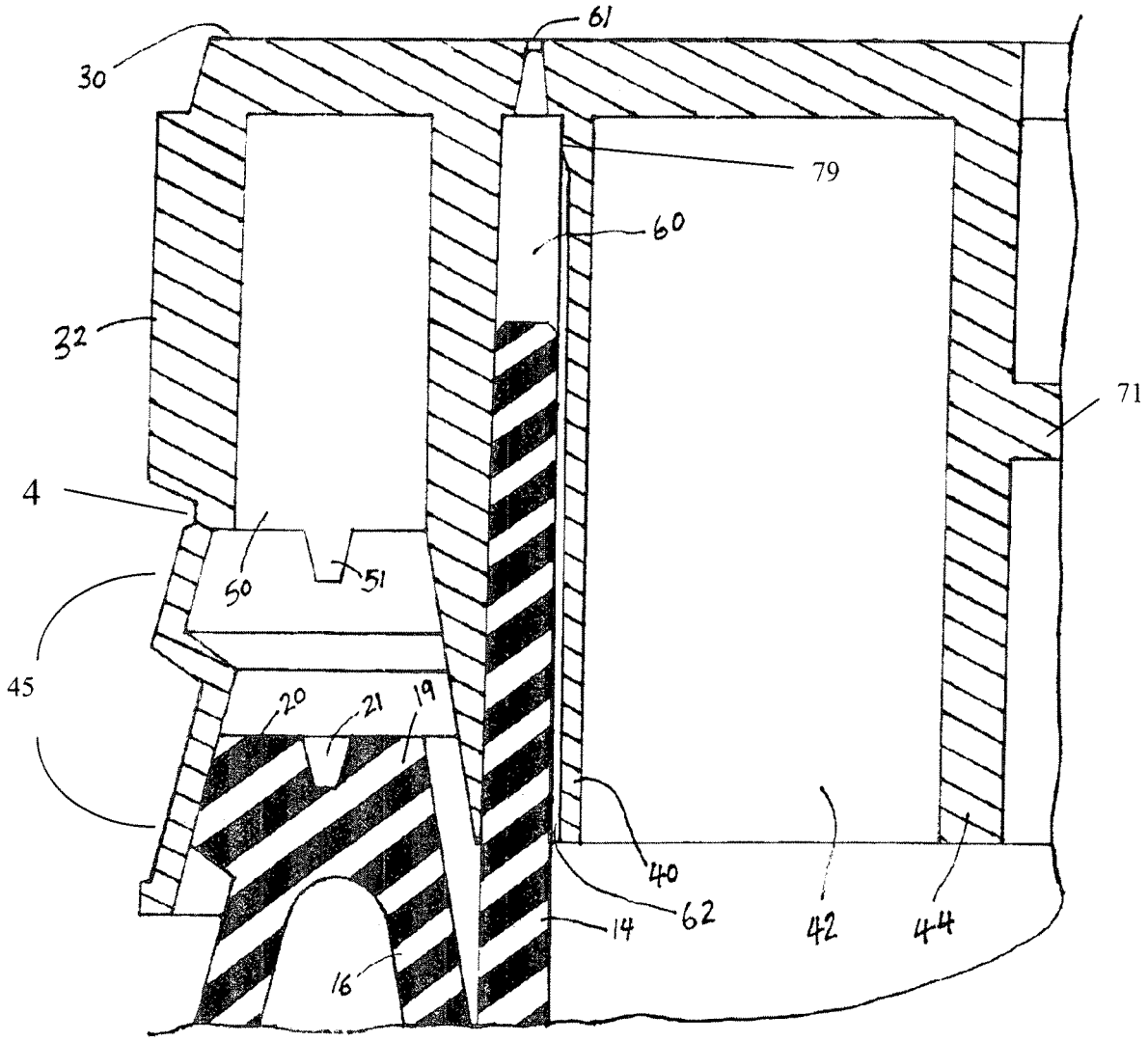
FIG. 20 is an enlarged detailed cross sectional elevation view of the container body and container cover when positioned in readiness for final locking engagement. This view also details the air pressure evacuation vents [62] and ports [61] which are positioned strategically in multiple positions on the container closure [30] integral member parts.

Furthermore, the invention member part [51], and as illustrated on FIG. 20, is a locking wedge key [51] which extends downward and as an extension of the integral part of the container cover [30] plurality of fins [50]. Upon final engagement of the container body [10] and the container closure [30] the container closure the locking wedge [51] locates within the container body [10] annular groove [21] maintaining the container body [10] annular flanges [20 & 19] in a preferred locking and sealing engagement relationship with the corresponding container closure [30] locking and sealing profile.

Figure 17:
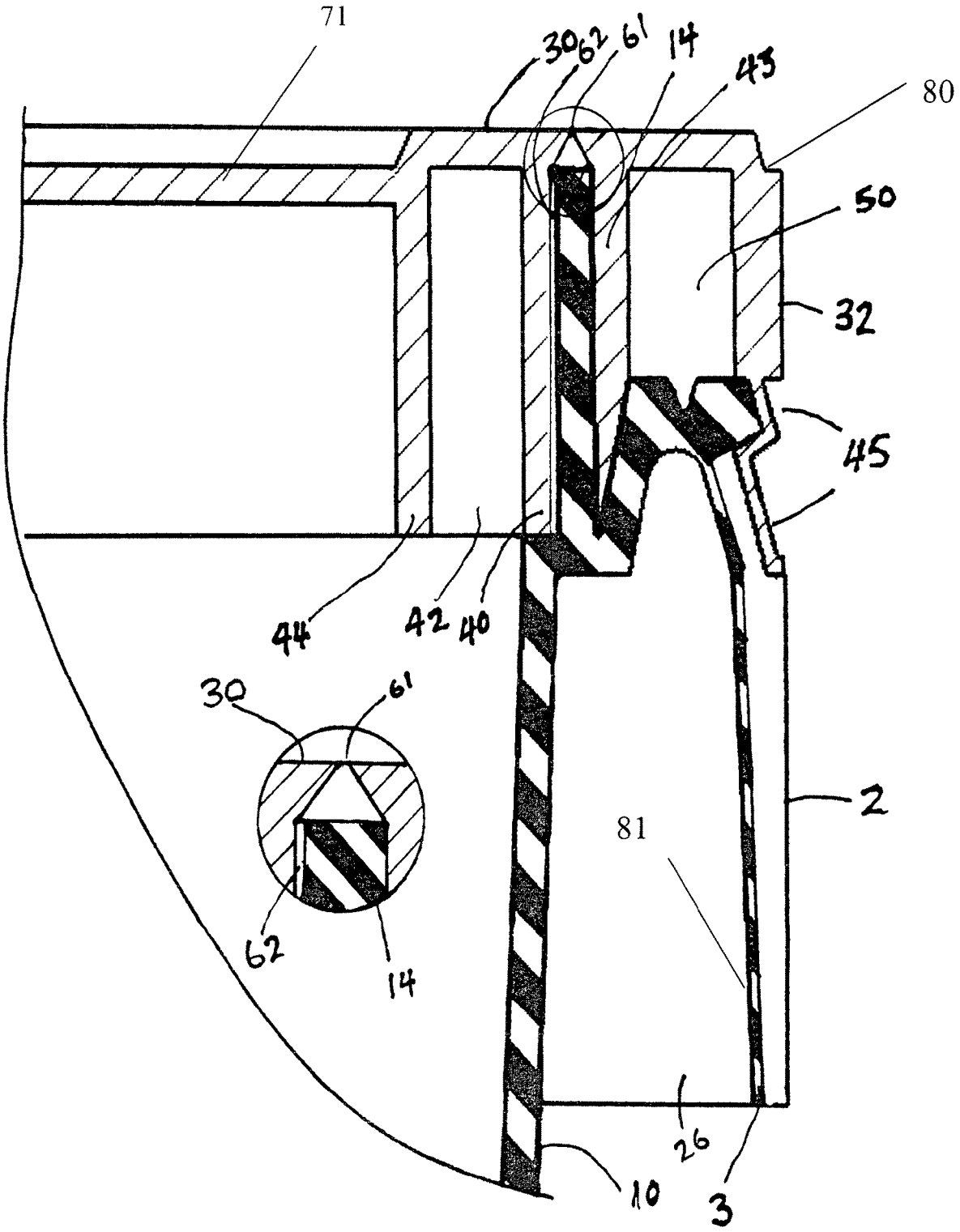
FIG. 17 is a detailed enlarged cross sectional elevation view of the container and cover after engagement and showing another embodiment of the invention being the air pressure evacuation vent and port system.
Figure 18:
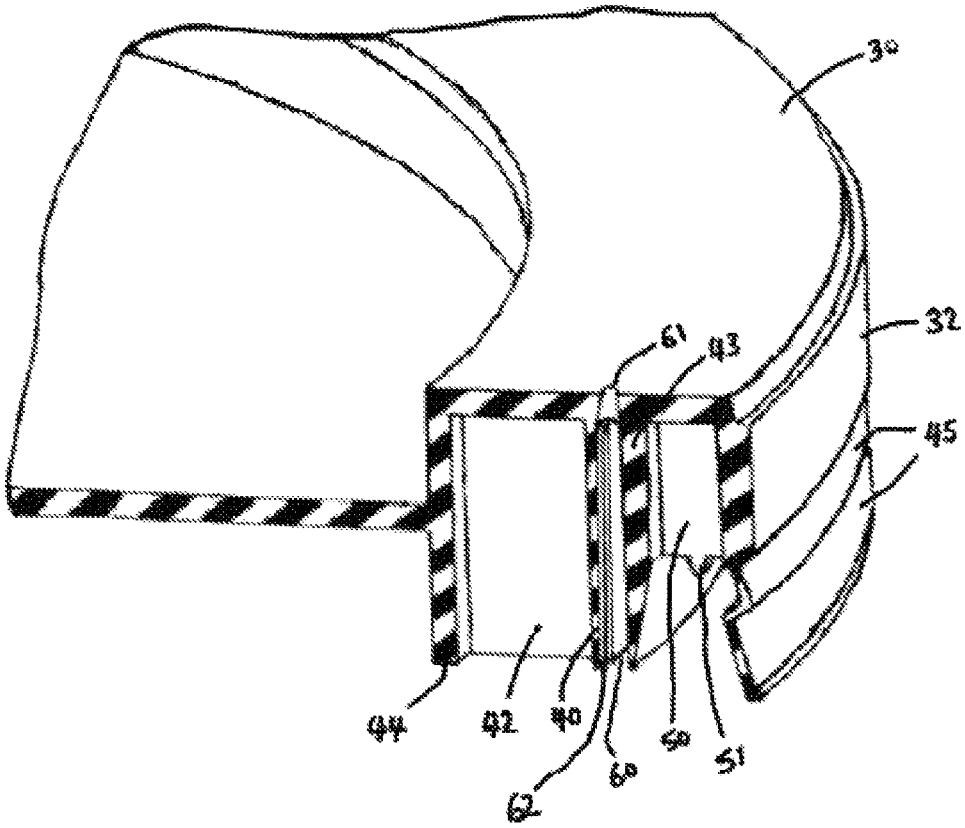
FIG. 18 is an enlarged detailed cross section perspective view of the container cover detailing the plurality of strengthening ribs and their given forms.
Figure 19:
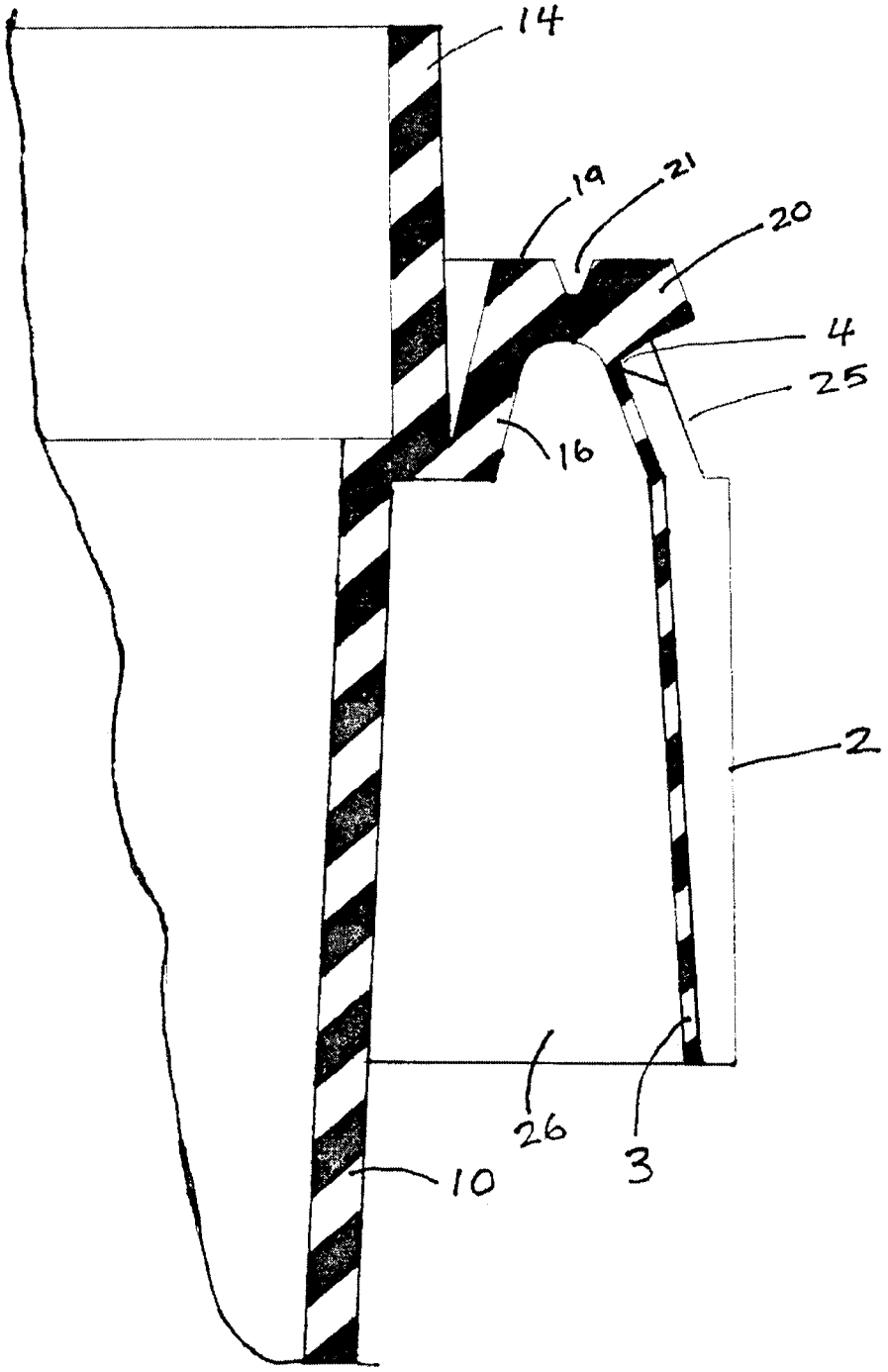
FIG. 19 is an enlarged detailed cross sectional elevation view of the container body [10] annular outer skirt [32] and showing the leverage panel [2] in its prior to pivoting first position.

Yet another aspect of the present invention and as illustrated on FIG. 17 and FIG. 20 is the corresponding internal air pressure relief evacuation vents [62] and ports [61]. The air pressure evacuation vents are located on the container cover [30] outer surface of the annular curtain [40] and the air pressure evacuation ports [61] are located on the upper top surface panel of the container closure [30]. Once the container internal head space air pressure has been normalized and container distortion and bulging has subsided an air tight and leak proof condition is achieved by way of the innermost surface engagement of the container member parts being the container body upper internal profile of the annular rim [14] and the container cover outer and upper profile of the annular curtain [79]. The above mentioned container member parts are illustrated on FIG. 20.

Figure 21:
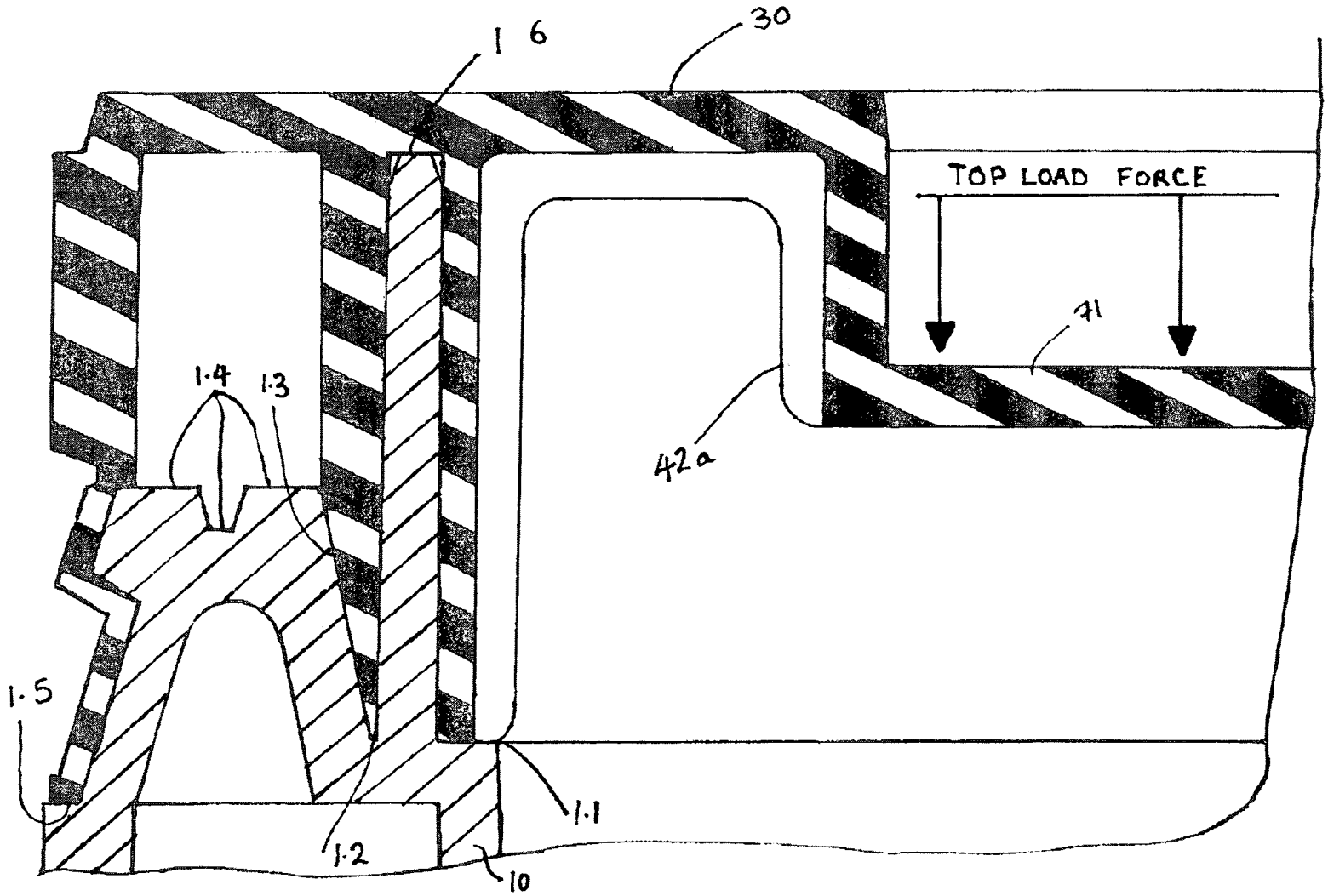
FIG. 21 is an enlarged detailed cross sectional view of the container body and container cover in its final locked and leak proof condition. Additionally all the container assembly top load force bearing points [1.1, 1.2, 1.3, 1.4, 1.5, and 1.6] are clearly illustrated. Furthermore an alternative container closure fin [42*a*] is also illustrated.
Figure 22:
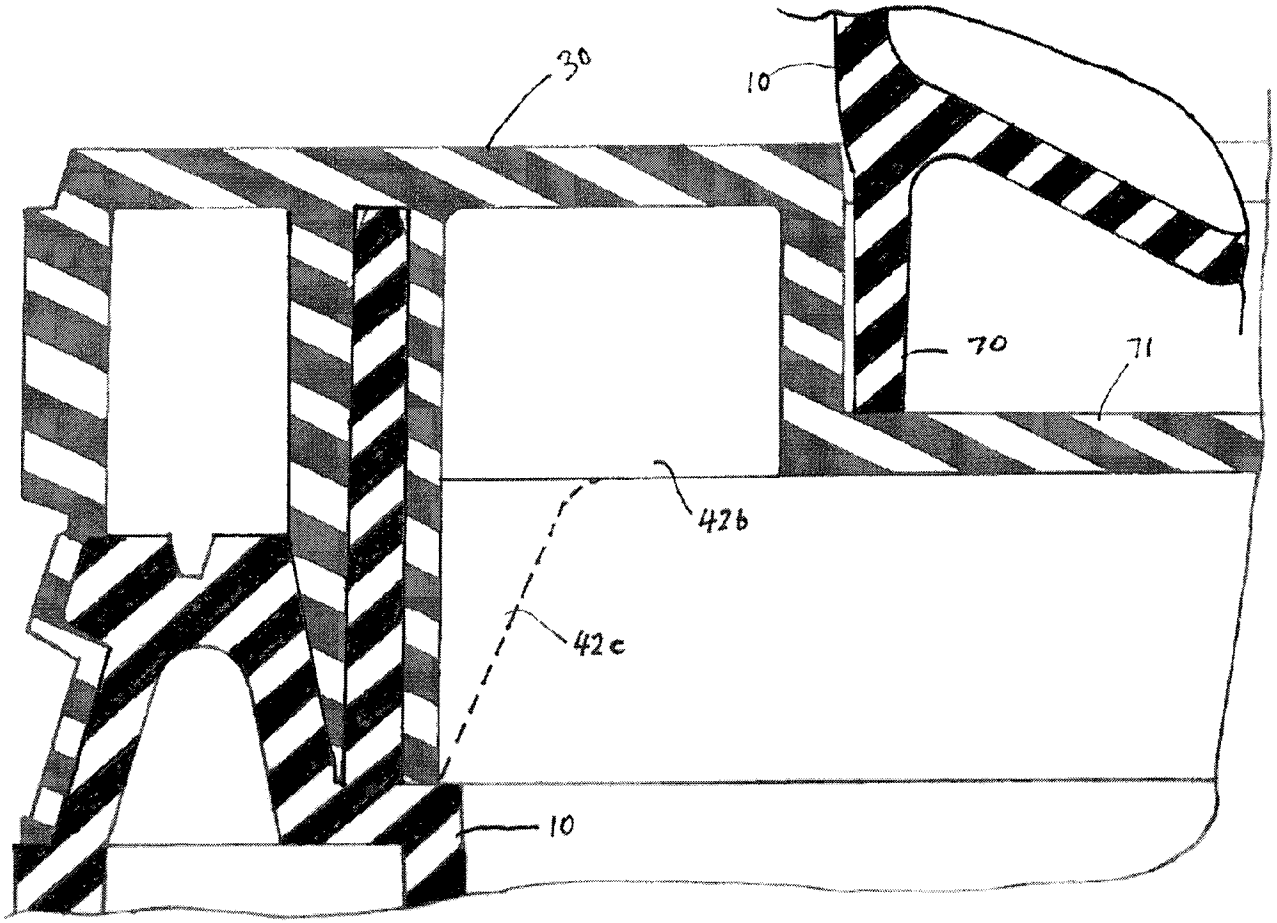
FIG. 22 is an enlarged detailed cross sectional view of the container body and container cover in its final locked and leak proof condition. The container body base rim [70] is also illustrated in its stacked and nested position within the container closure recessed centre panel [71]. Alternative container closure fins profiles [42*b* and 42*c*] are also illustrated.
Figure 23:
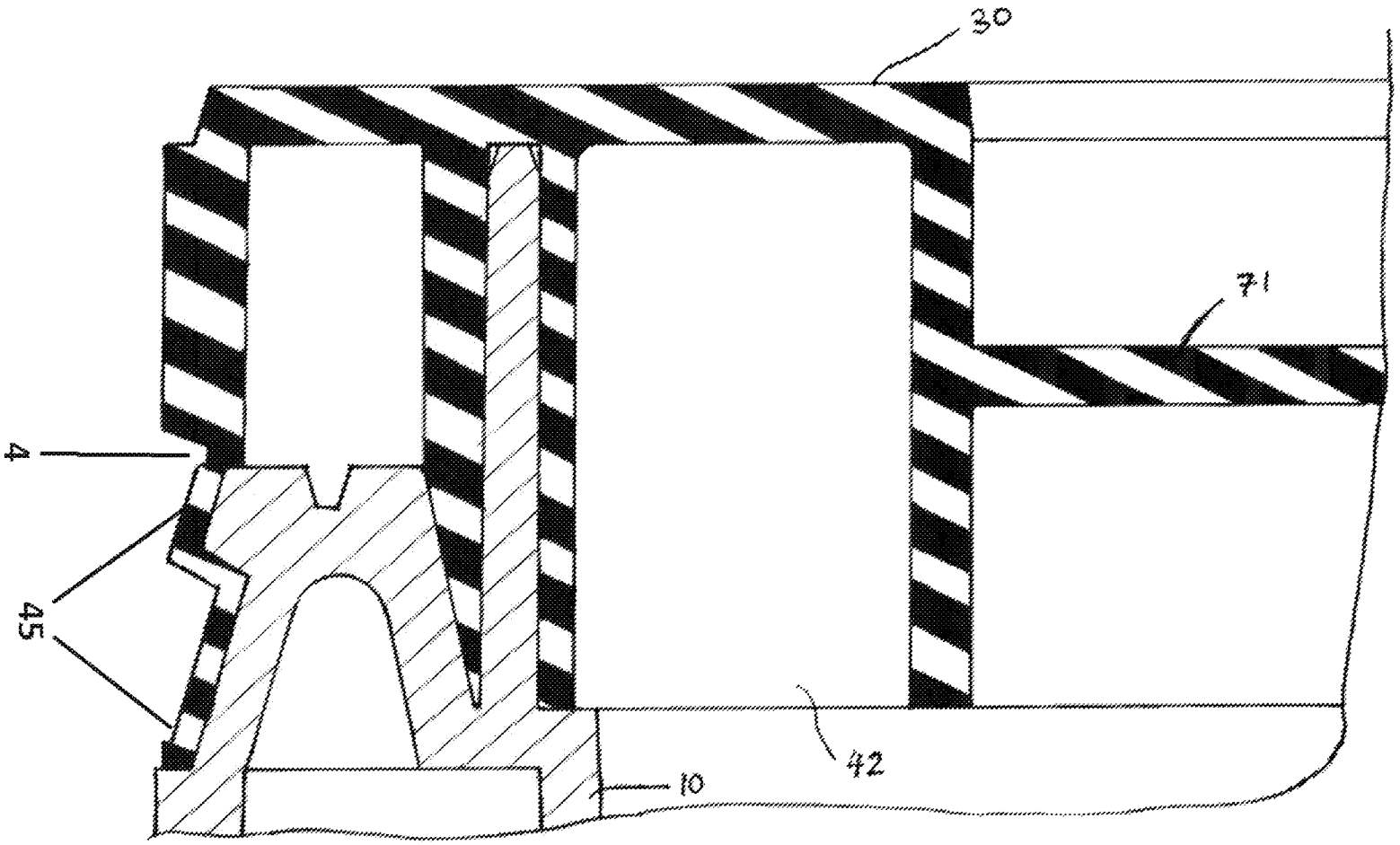
FIG. 23 is an enlarged detailed cross sectional view of the container body [10] and container cover [30] in its final locked and leak proof condition and illustrating the container closure fin [42] in its full non recessed condition.
Figure 24:
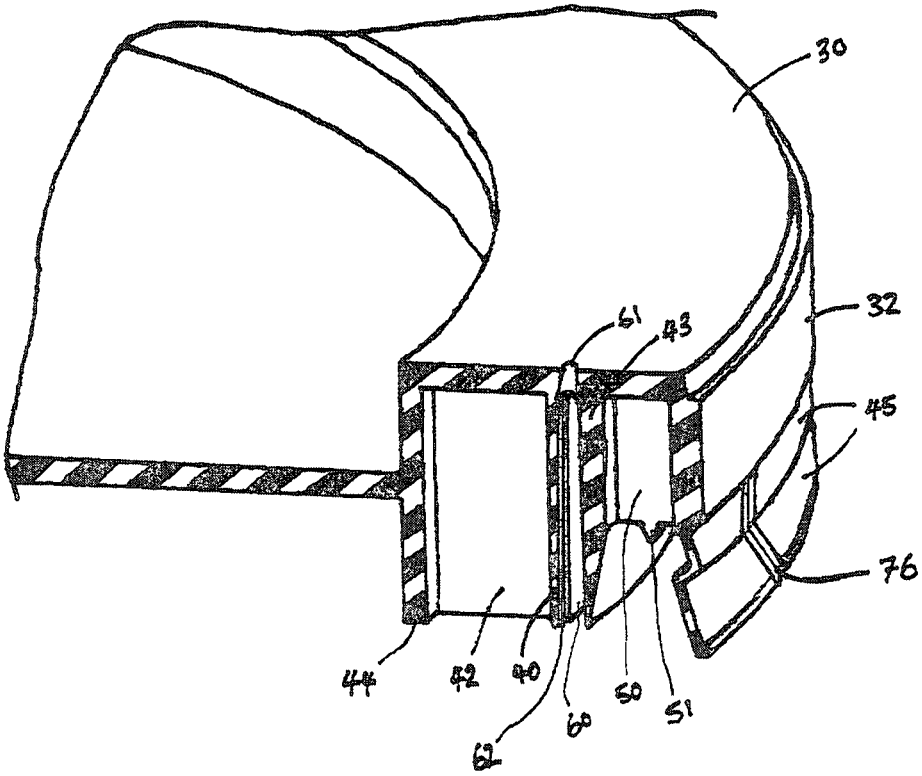
FIG. 24 is an enlarged detailed cross section perspective view of the container cover [30] detailing the two integral annular and angular elastic ring bands [45] with the notch groove [76] in position.

Another aspect of the present invention is the multiple load bearing points and when the container closure [30] and the container closure annular recessed center panel [71] is subjected to top load weight. As illustrated on FIG. 21 these load bearing points are detailed as member parts [1.1, 1.2, 1.3, 1.4, 1.5 and 1.6], the distribution of top load force, and as illustrated on FIG. 22, minimizes container closure top panel distortion and buckling as well as container body [10] side wall deflection.

Yet another aspect of the present invention is the positioning of a plurality of notch grooves [76] in a perpendicular relationship to the container closure [30] top panel surface and positioned on the outer surface of the annular, angled elastic ring bands [45]. The addition of such notch grooves [76] allows for easier part ejection from the injection mould and or easier container closure [30] removal from the container body [10] and upon opening of the container assembly.

It will be appreciated by those skilled in the art that the number of annular flanges on the container body and the corresponding number of annular notches and rings in the lid need not be limited to and as written and illustrated in the above described preferred embodiment.

Whilst the invention has been described in connection with what is presently considered to be the most practical and preferred embodiments, it must be understood that the invention is not to be limited to the disclosed embodiments but is intended to cover various modifications and applications and equivalent arrangements included within the spirit and scope of the appended claims, which scope is to be accorded the broadest interpretation so as to encompass all such modifications and equivalent structures and forms and as permitted under the law.

Although the present invention has been described and illustrated in detail, it should be clearly understood that the same is by way of illustration and example only and is not to be taken by way of limitation, the spirit and scope of the present invention being limited by the terms of the appended claims.

CITATION LIST

U.S. Pat. No. 3,107,838 * Mar. 16, 1960 Oct. 22, 1963 Celluplastics Inc Bottom closure for a plastic container U.S. Pat. No. 3,532,244 * Jan. 17, 1969 Oct. 6, 1970 Growth Int Ind Corp Seal for resealable bucket closure U.S. Pat. No. 3,811,597 * Apr. 17, 1972 May 21, 1974 Continental Can Co Plastic container U.S. Pat. No. 4,034,889 * Feb. 11, 1976 Jul. 12, 1977 Mauser Kommanditgesellschaft Plastic container-cover assembly U.S. Pat. No. 4,538,741 * Nov. 2, 1983 Sep. 3, 1985 Jacobs Stanley A Container and lid U.S. Pat. No. 4,919,286 * May 27, 1988 Apr. 24, 1990 Robert Linkletter Assoc. Hinged closure and container U.S. Pat. No. 5,092,478 * May 20, 1991 Mar. 3, 1992 Pierre MauriceTamper-evident tear-off strip for container cap U.S. Pat. No. 5,143,219 * Apr. 8, 1991 Sep. 1, 1992 Yates Jr George Stackable container with protected lid seal U.S. Pat. No. 5,163,576 * Apr. 14, 1992 Nov. 17, 1992 Galer Herbert W Lid and container assembly U.S. Pat. No. 5,292,024 * May 19, 1992 Mar. 8, 1994 Rehrig Pacific Company, Inc. Plastic pail assembly for hazardous materials U.S. Pat. No. 6,041,953 * Mar. 5, 1998 Mar. 28, 2000 Goodall; Donald Terry Containers and closures therefor U.S. Pat. No. 6,126,027 * Aug. 21, 1997 Oct. 3, 2000 Mcg Closures Limited Self-centering container closure U.S. Pat. No. 6,257,435 * Jan. 12, 2000 Jul. 10, 2001 King Plastics, Inc. Tamper evident closure member U.S. Pat. No. 6,360,886 Mar. 13, 2000 Mar. 26, 2002 Kerr Corporation Capsule for use in preparing a dental amalgam U.S. Pat. No. 6,360,908 * Nov. 19, 1999 Mar. 26, 2002 Rieke Corporation Tamper-evident drum closure overcap U.S. Pat. No. 6,543,635 Mar. 20, 2001 Apr. 8, 2003 Top Grade Molds Ltd. Container lid with tear-off strip U.S. Pat. No. 6,619,498 * Aug. 8, 2001 Sep. 16, 2003 Von Holdt, Jr. John W. Plastic container and lid construction U.S. Pat. No. 6,688,483 Oct. 15, 2001 Feb. 10, 2004 Letica Corporation Molded plastic pail with double lock U.S. Pat. No. 6,779,676 Feb. 11, 2003 Aug. 24, 2004 Injectnotech Inc. Container lid with tear-off strip U.S. Pat. No. 6,834,772 Aug. 10, 2000 Dec. 28, 2004 Superfos A/S Packaging U.S. Pat. No. 6,880,716 May 9, 2003 Apr. 19, 2005 Joseph Gottainer Plastic lid construction U.S. Pat. No. 7,063,230 * Dec. 19, 2002 Jun. 20, 2006 Injectnotech Inc. Container with hinged lid U.S. Pat. No. 7,086,551 Jul. 17, 2003 Aug. 8, 2006 Von Holdt Jr John W Plastic container and lid construction U.S. Pat. No. 7,090,088 Nov. 25, 2003 Aug. 15, 2006 Von Holdt Jr John W Plastic container and lid construction U.S. Pat. No. 7,207,457 Jan. 7, 2004 Apr. 24, 2007 Letica Corporation Closure with tear strip U.S. Pat. No. 7,896,185 * Mar. 1, 2011 Kw Plastics Plastic container having gasketless seal U.S. Pat. No. 7,922,028 Apr. 12, 2011 Rehrig Pacific Company Pail with lid and flashed lip U.S. Pat. No. 7,963,419 * Jun. 21, 2011 Bway Corporation Lid and container U.S. Pat. No. 8,162,165 Apr. 24, 2012 Bway Corporation Pail and closure U.S. Pat. No. 8,181,819 * May 22, 2012 Bway Corporation Lid and container U.S. Pat. No. 8,210,391 * Jul. 3, 2012 Ropak Corporation Performance oriented pail U.S. Pat. No. 8,231,025 Jul. 31, 2012 Liqui-Box Corporation Dispensing process using tamper evident fitment assembly for a container U.S. Pat. No. 8,308,004 Nov. 13, 2012 Rexam Healthcare Packaging Inc. Dispensing package having non-removable and non-rotatable dispensing closure U.S. Pat. No. 8,459,486 Apr. 19, 2010 Jun. 11, 2013 Ropak Corporation Container and lid U.S. Pat. No. 8,523,009 * Mar. 31, 2006 Sep. 3, 2013 Innovative Design Co., Pty Ltd. Container closure with deformable region in skirt to allow pivoting U.S. Pat. No. 9,011,407 * Jul. 3, 2008 Apr. 21, 2015 Pfm Medical Ag Pre-evacuatable or pre-evacuated container for medical purposes U.S. Pat. No. 9,226,455 * Feb. 19, 2014 Jan. 5, 2016 Att Southern Inc. Molded planter with wide upper rim US20020148846 * Apr. 12, 2001 Oct. 17, 2002 Ropak Corporation Container lid having gasketless liquid seal US20040011790 * Oct. 9, 2001 Jan. 22, 2004 Woinarski David Alexander Container-closure arrangement US20040016757 * Jun. 20, 2003 Jan. 29, 2004 Von Holdt John W. Plastic container and lid construction US20040045966 * Jul. 17, 2003 Mar. 11, 2004 Von Holdt John W. Plastic container and lid construction US20040079757 * Dec. 19, 2002 Apr. 29, 2004 Vince CicconeContainer with hinged lid US20040112906 * Nov. 25, 2003 Jun. 17, 2004 Plas-Tool Company Plastic container and lid construction US20040195251 * Nov. 19, 2003 Oct. 7, 2004 Plas-Tool Company Plastic bucket and lid stacking construction US20040222226 * May 9, 2003 Nov. 11, 2004 Joseph Gottainer Plastic lid construction US20050121452 * Mar. 13, 2003 Jun. 9, 2005 Stoltz Hendrik F. Containers and methods of production thereof US20050145628 * Jan. 7, 2004 Jul. 7, 2005 Schwarz Stefan H. Closure with tear strip US20060138156 * Oct. 13, 2003 Jun. 29, 2006 Richard Kellerer Container with a safety seal US20070084870 * Oct. 14, 2005 Apr. 19, 2007 Frano Luburic Performance oriented pail US20070102438 * Dec. 27, 2006 May 10, 2007 Schwarz Stefan H Closusre with tear strip US20070181578 * Jul. 30, 2004 Aug. 9, 2007 James JohnsonTamper evident fitment assembly US20070205196 * Oct. 10, 2006 Sep. 6, 2007 Bway Corporation Lid and Container US20080217338 * Mar. 6, 2007 Sep. 11, 2008 Campbell Newton K Plastic container having gasketless seal US20080230550 * Mar. 5, 2008 Sep. 25, 2008 Bway Corporation Lid and container US20090012493 * Jul. 3, 2008 Jan. 8, 2009 Volker Harig Pre-evacuatable or pre-evacuated container for medical purposes US20090014456 * Mar. 31, 2006 Jan. 15, 2009 Innovative Design Co. Pty Ltd. Container closure with deformable region in skirt to allow pivoting US20090026203 * Jul. 23, 2007 Jan. 29, 2009 Letica Corporation Plastic container with double lock lid and tear band US20090294322 * Jun. 2, 2008 Dec. 3, 2009 Baltz Kyle L Pail with skirt and lid US20090314780 * Dec. 24, 2009 Letica Corporation Plastic container with double lock lid US20100213195 * Aug. 26, 2010 Baltz Kyle L Pail with lid and flashed lip US20110084074 * Apr. 14, 2011 Reed Angela M Pail and closure US20110155758 * Jun. 30, 2011 Liqui-Box Corporation Fitment Assembly for a Container Having a Tamper Indication Band Attached Thereto US20130098914 * Jan. 7, 2011 Apr. 25, 2013 Superfos A/S Container US20140215919 * Feb. 19, 2014 Aug. 7, 2014 Att Southern, Inc. Molded planter with wide upper rim U.S. D734980 Aug. 6, 2014 Jul. 28, 2015 Kraft Foods Group Brands Llc Lid for a container WO2002030780A1 * Oct. 9, 2001 Apr. 18, 2002 Innovative Design Co Pty Ltd Container-closure arrangement WO2003076293A2 * Mar. 13, 2003 Sep. 18, 2003 Elopak Systems Ag Container closure arrangement WO2003076293A3 * Mar. 13, 2003 Feb. 26, 2004 Elopak Systems Container closure arrangement

The invention claimed is:

1. A sealable container comprising:

a dual purpose detachable handle grip/tool (37) for opening;

an air pressure evacuation system formed by (61) and internal channels (62) of a container cover (30);

a plurality of strengthening fins of the container, being elements (42), (50) of the container cover (30) and an element (26) of the container body (10);

a combination of annular, curved elastic ring bands (45) and a notch groove (25), forming a main locking mechanism of the container when engaged;

a combination of an annular groove (60) and an annular rim (14), forming a main sealing mechanism of the container when engaged;

a combination of notch grooves (3 and 76) and hinge grooves (4), allowing for partial separation of a part of an annular skirt (22) element of the container body and for movement when opening the container;

a combination of notch grooves (3 and 76) allowing for separation of a part of the annular skirt (22) element of the container body which in turn visually display tamper proof evidence and after the container has been opened at the point of first usage;

a combination of top load bearing surfaces at points (1.1, 1.2, 1.3, 1.4, 1.5 and 1.6) to improve the container top load performance;

a combination of malleable, compressible and expandable parts of the container body (10) allowing for achieving at the same time an air tight and leak proof performance of the package when engaged, wherein the container body (10) has an open top with an annular rim (14) around it, an annular flange (16) formed in the axial direction and extending radially outwards from an external wall of the container body (10), said annular flange is integral with the container body containing a pair of concentrically spaced annular flanges (19 and 20) disposed on the radially outward and angularly extending annular flange (16) extending from the upper portion of the container body, and an annular skirt (22) extending radially outwards from an undersurface of the annular flange; and a container cover (30), having a peripheral annular skirt which includes an extension being the annular and curved annular elastic ring bands (45) formed therein according to the corresponding mating profile of the notch groove (25) in the annular flange of the container body (10), wherein the container cover is configured for latching engagement with corresponding said notch groove (25) in the annular flange of the container body in a respective one-to-one relationship; and a first and second annular curtains (40, 43) disposed from the undersurface of the container cover (30) and configured to fit an inner wall of the container body (10) and its annular rim (14) in a compression fit manner;

characterized in that the external annular skirt (32) of the container body contains a partially detachable, integral and articulated (4) lever panel (2), which, when manually operated upward and outward, first separates the adjacent notch grooves (3) from the annular skirt (32) of the container body and when continuing the lever movement detaches the corresponding mating parts (45 and 25) of the container which facilitates the opening of the closed container, wherein the partially detachable integral and articulated lever panel (4) may be located in more than one position on the external peripheral skirt (32) of the container body depending on the final shape of the container body, which is cylindrical or rectangular.

2. The sealable container of claim 1, characterized in that plurality of are between the a plurality of fins (26) of the container are located between the annular skirt of the container body (10) and the external wall of the container body (10), said fins (26) being integrally formed with the annular skirt and the container body.

3. The sealable container of claim 1, characterized in that a plurality of fins (42) of the container cover are located between the first and second annular curtains (43 and 40), said fins of the container cover being integrally formed with the underside of the top of the container cover and the annular curtains to extend there between in a radial direction.

4. The sealable container of claim 1, characterized in that a plurality of fins (50) of the container cover are located between the annular skirt of the container cover (32) and the second annular curtain (43) and on the underside of the container cover (30) top, said fins (50) being integrally formed with the underside of the container cover (30) top, the second annular curtain (43) and the external annular skirt (32) of the container cover to extend there between in a radial direction.

5. The sealable container of claim 1, characterized in that the container body (10) includes a notch groove (25) of the annular flange, and the container cover (30) includes two integral annular curved elastic ring bands (45) correspondingly formed and disposed to respectively and fit together upon the final container assembly thereto.

6. The sealable container of claim 1, characterized in that the annular skirt (22) of the container body (10) extends from and below an underneath part of the notch groove (25) of the annular flange.

7. The sealable container of claim 1, characterized in that the fins (26) of the container body extend from the upper inner edge of the annular skirt to the annular flange (16) and then connect to the container body (10) in a curved and radially formed configuration.

8. The sealable container of claim 1, characterized in that a plurality of fins (42) of the cover are located between the first annular curtain (40) of the container cover (30) and underneath of the top of the container cover (30), said fins (42) of the cover being integrally formed with the top of the cover and the annular curtain to extend there and between in a radial direction.

9. The sealable container of claim 1, characterized in that the annular skirt of the container cover (30) includes the annular curved elastic ring band (45) located around it and extending downward from the lower portion (32) of the annular skirt.

10. The sealable container of claim 1, characterized in that the container cover contains malleable expandable elastic and annular curved ring bands (45), which can be manually folded upwards without fracture when opening the container and manually returned to its original locked and engaged position with the corresponding annular notch groove (25) of the container body, wherein the malleable expandable elastic and annular curved ring bands (45), dimensionally formed considerably thinner than the general section of the wall of the container cover (30), allows for elasticity, in particular when closing the container into its final locked and sealed position.

11. The sealable container of claim 1, characterized in that an element (38) of the metal handle of the container body contains an attachable/detachable multifunctional handle grip/tool (37) configured for latching engagement, which when moved from the first hand-carrying position, can be used as a lever to generate upwards and outwards motion of an integral lever panel (2) of the annular skirt (22) of the container body and to generate the complete removal of the container closure (30) from the container body (10); once the container closure is removed multifunctional handle grip/tool (37) may be refitted onto the element (38) of the metal handle into its hand carry useful position.

12. The sealable container of claim 1, characterized in that the malleable expandable curved and elastic ring bands (45) of the container cover may be reengaged with the corresponding notch groove (25) of the container body annular skirt and upon closing and to recover its first sealed and leak proof engagement.

13. The sealable container of claim 1, characterized in that the container closure (30) of the container may have one or more air pressure evacuation vents (62) located on the external wall of the first annular curtain (40), aligned in a vertical position directly adjacent to one or more air evacuation ports (61); as the annular rim (14) of the container body (30) enters the adjacent annular groove (60) of the container cover (30) and during the process of closing the container cover inside the container, it is necessary to remove the air trapped inside and eliminate the bulging of the container cover; the air pressure evacuation vents (62) and ports (61) of the container cover allow the trapped air to escape during the closing process until final fitment of the mating parts, wherein the vents and ports are isolated to prevent leakage of the packaged product, in particular fluids; wherein the air pressure evacuation vent (62) extends vertically upwards, but stopping just short of the absolute inner bottom surface of the annular groove (60) of the container cover; this full profile (69) provides a full annular sealing between the parts of the container element (14 and 60), preventing leakage of packaged products, such as fluids, once the container body and closure are in their final locked and fitted engagement.

14. The sealable container of claim 1, characterized in that the container includes a number of element parts which are malleable which when placed under multiple directional pressures may be formed to create a more desirable fitment between the mating and corresponding assembly element locking and sealing parts, these multiple directional pressures are created automatically when the container body (10) is engaged with the container cover (30) in its final leak proof and air tight position, element parts being the container body (10) annular flanges (19 and 20) and due to them being partially divided by annular notch groove (21) allows for a compression fitment when engaged under pressure within corresponding container cover (30) mating element parts (45 and 43) to further maintain those element parts (19 and 20) in a compressible condition the container cover (30) plurality of fins (50) include extended fin keys (51) which lock into and wedge outwards the compressed annular flanges (19 and 20) when engaged in their final locked and sealed engagement.

15. The sealable container of claim 1, characterized in that the assembled container top load performance, and when in use, is improved due to the combination of 6 separate load bearing points being (1.1, 1.2, 1.3, 1.4, 1.5 and 1.6) wherein when the top load force is exerted and for instance when a full container body (10) base rim is stacked on top of and within the container closure (30) recessed centre panel, and upwards of 180 kg of static weight must be supported, by disturbing that weight across 6 load bearing points deformation of those bearing points and other container member parts is significantly reduced.

16. The sealable container of claim 1, characterized in that two integral annular curved and elastic ring bands (45) of the container cover (30) may have a plurality of notch grooves (76); wherein the addition of such notch grooves allows for part sectional separation of portions of the annular ring bands (45) and during the process of leverage opening of the container closure (30) off the container body (10) from its closed and assembled engagement.

* * * * *